US007372428B1

(12) United States Patent
King

(10) Patent No.: US 7,372,428 B1
(45) Date of Patent: May 13, 2008

(54) DISH ANTENNA WITH MULTIPLE CONTACT CONNECTOR ASSEMBLY

(75) Inventor: Lael D. King, Minneapolis, MN (US)

(73) Assignee: King Controls, Bloomington, MN (US)

( * ) Notice: Subject to any disclaimer, the term of this patent is extended or adjusted under 35 U.S.C. 154(b) by 84 days.

(21) Appl. No.: 11/333,723

(22) Filed: Jan. 17, 2006

Related U.S. Application Data

(60) Provisional application No. 60/707,495, filed on Aug. 11, 2005.

(51) Int. Cl.
*H01Q 1/50* (2006.01)
*H01Q 19/22* (2006.01)
*H01Q 15/24* (2006.01)

(52) U.S. Cl. ..... 343/906; 343/912; 343/840

(58) Field of Classification Search ..... 343/906, 343/840, 912; 439/578, 63, 581, 916
See application file for complete search history.

(56) References Cited

U.S. PATENT DOCUMENTS 4,426,127 A * 1/1984 Kubota ..... 439/609
4,878,863 A * 11/1989 Swengel Jr. et al. ..... 439/884
6,471,545 B1 * 10/2002 Hosler, Sr. ..... 439/585

* cited by examiner

*Primary Examiner*—Trinh Dinh
*Assistant Examiner*—Dieu Hien T Duong
(74) *Attorney, Agent, or Firm*—Hugh D. Jaeger, Esq.

(57) ABSTRACT

A dish antenna having a multiple contact connector assembly for utilization with one or more viewing systems or other systems such as two-way data exchange systems including satellite receivers and/or television receivers. The single positionable dish can be positioned azimuthally and elevationally to access satellite signals which are then distributed to one or more viewing or other systems. The dish antenna receives and distributes satellite signals utilizing an LNB (low noise block) and a multiple contact connector assembly which features a multiple contact rotary male connector and a multiple contact rotary female connector which mutually engage each other in rotary and sliding contact for multiple circuit passthrough of satellite signals, control voltages and the like in order that one or more viewing or other systems can be used to view or otherwise employ multiple and different channels simultaneously and in order that no cable wrap-up will occur.

1 Claim, 12 Drawing Sheets

DISH ANTENNA WITH MULTIPLE CONTACT CONNECTOR ASSEMBLY

CROSS REFERENCES TO RELATED APPLICATIONS

This application claims priority from the earlier filed U.S. Provisional Application No. 60/707,495 filed Aug. 11, 2005, entitled "Dome Antenna With Dual Connector Assembly." The prior application is hereby incorporated into this application by reference as if fully set forth herein.

BACKGROUND OF THE INVENTION

Field of the Invention

The present invention relates to satellite receivers and, more particularly, to a dish antenna incorporating a multiple contact connector assembly to provide for passage of multiple RF signals or other electrical currents for use by one or more satellite receivers or other devices.

SUMMARY OF THE INVENTION

The general purpose of the present invention is a to provide a dish antenna with a multiple contact connector assembly for utilization with one or more viewing or other systems including satellite receivers and television receivers. A single positionable dish antenna can be positioned azimuthally and elevationally to access satellite signals which are then distributed to one or more viewing systems. The dish antenna receives and distributes satellite signals utilizing an LNB and a multiple contact connector assembly which features a multiple contact rotary male connector and a multiple contact rotary female connector which offer multiple circuit passthrough capabilities of satellite signals, control voltages, and the like so that one or more viewing systems or other systems can be used to view or otherwise employ multiple and different channels simultaneously.

The multiple contact rotary male connector and the multiple contact rotary female connector mutually engage each other in rotary and sliding contact. The described multiple contact rotary male connector and multiple contact rotary female connector include provisions for a sliding common contact means for cooperation with and for conveying signals or other voltages through two other sliding contact means, as now described:

a. the multiple contact rotary female connector includes a contact socket which rotatingly and slidingly engages a contact pin in the multiple contact rotary male connector for communication of a first RF signal or other electrical current therethrough;

b. the multiple contact rotary female connector includes an intermediate conductor in communication with and in coaxial alignment with a segmented spring contact socket which together serve as a conductor for communication of common RF signals or other electrical current. The segmented spring contact socket is flexible and rotatingly and slidingly engages a cylindrical contact of the multiple contact rotary male connector for communication of a common RF signal or other common electrical current therethrough; and, c. the multiple contact rotary female connector includes an outer conductor for communication of an RF signal or other electrical current having a segmented spring contact socket which is flexible and which rotatingly and slidingly engages a cylindrical contact of the multiple contact rotary male connector for communication of a second RF signal or other electrical current therethrough.

Alternatively, additional cooperating contacts can be incorporated into the multiple contact rotary male and female connectors in concentric fashion to provide for passage of more than two RF paths or other electrical current therethrough.

Elevational control and azimuthal control of a dish antenna and other associated electrical and mechanical devices are provided for signal acquisition and viewing from a moving or stationary vehicle, boat, or the like by methods known in the art.

According to one or more embodiments of the present invention, there is provided a dish antenna having a multiple contact connector assembly including a bearing assembly having an inner part and an outer part, the inner part being mounted to a frame and the outer part being mounted to a base plate, a drive belt and motor which azimuthally position the outer part of the bearing assembly, a dish antenna including an LNB (low noise block) rotatably secured to the upper portion of the frame, a motor which controls the elevation of the dish antenna, an enclosure dome and an enclosure base, a multiple contact connector assembly having a multiple contact rotary male connector and a multiple contact rotary female connector mutually and coaxially aligned and engaged in rotary and sliding contact including provisions for a sliding common contact means for cooperation with and for conveying signals or other voltages through two other sliding contact arrangements, an RF box, a control circuit board, and other closely associated electrical and mechanical components.

One significant aspect and feature of the present invention is a dish antenna having a multiple contact connector assembly.

Another significant aspect and feature of the present invention is a multiple contact connector assembly having a multiple contact rotary male connector and a multiple contact rotary female connector mutually and coaxially aligned and engaged in rotary and sliding contact.

Still another significant aspect and feature of the present invention is a multiple contact rotary male connector having a central conductor, an intermediate conductor, and an outer conductor coaxially aligned and separated by insulators dispersed therebetween.

Still another significant aspect and feature of the present invention is a multiple contact rotary female connector having a central conductor, an intermediate conductor, and an outer conductor coaxially aligned and separated by insulators dispersed therebetween.

Yet another significant aspect and feature of the present invention is the combination of the multiple contact connector assembly with other electrical and mechanical devices known in the art.

Having thus briefly described an embodiment of the present invention and having mentioned some significant aspects and features of the present invention, it is the principal object of the present invention to provide a dish antenna with multiple connector assembly.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENT

Figure 1:
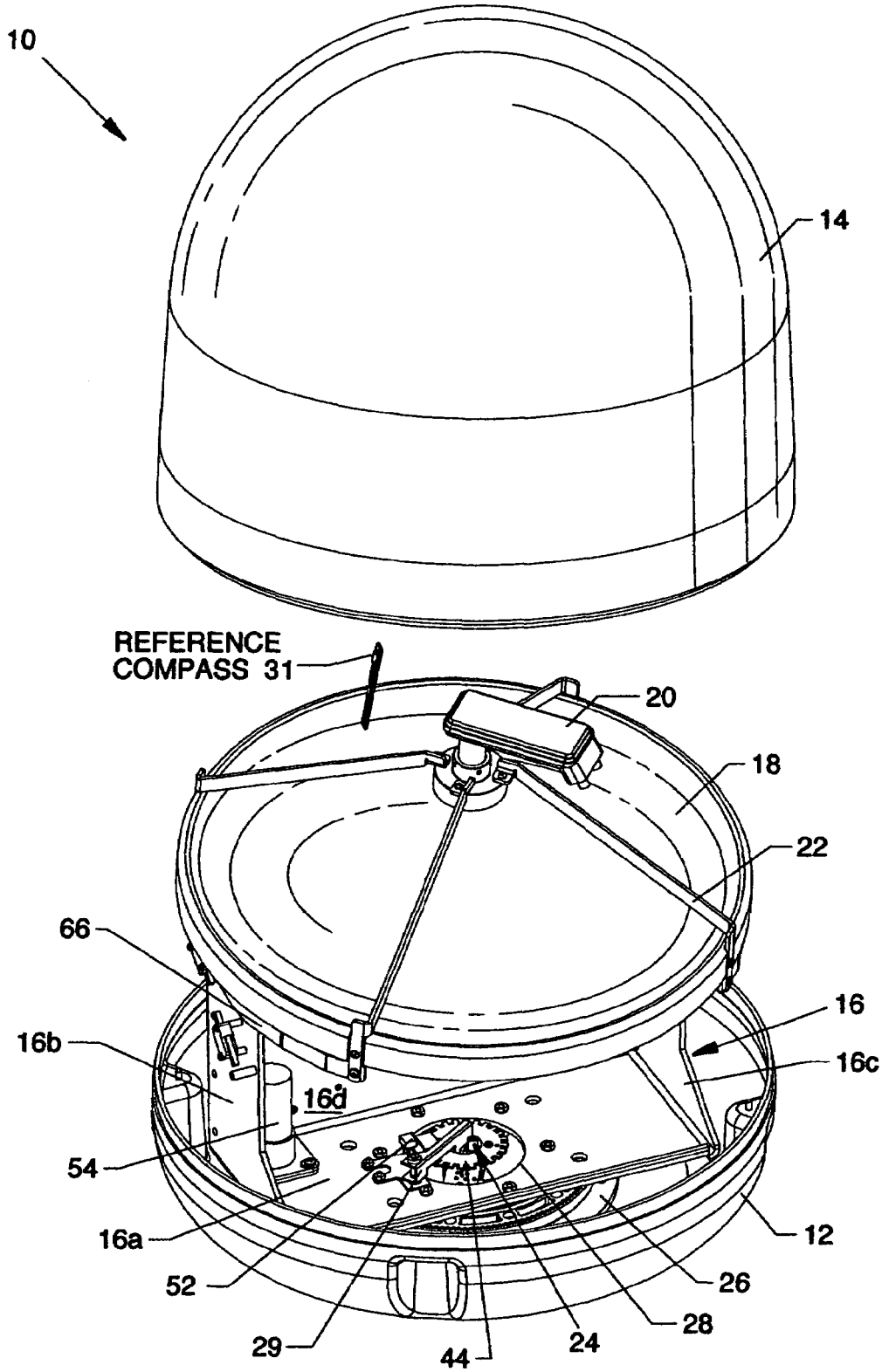
FIG. 1 is a semi-exploded view of a dish antenna with multiple contact connector assembly, the present invention, showing readily observable components and other structures.

FIG. 1 is a semi-exploded view of a dish antenna with multiple contact connector assembly 10, the present invention, showing readily observable components and other structures including an enclosure base 12, an enclosure dome 14, a frame 16 having a dish antenna 18 mounted thereupon, the frame 16 and dish antenna 18 being azimuthally and continuously positionable about a central vertical axis and the frame 16 including a bottom panel 16*a*, opposed side panels 16*b* and 16*c*, and a back panel 16*d*. The dish antenna 18 is also elevationally positionable, by virtue of being pivotally secured to the frame 16, and includes an LNB 20 (low noise block) and an LNB mounting framework 22. A partially visible multiple contact connector assembly 24 is mounted by a bracket 48 (FIG. 3) to a circular base plate 26 and is aligned with the central vertical axis and extends through a large aperture 28 in the bottom panel 16*a* of the frame 16. A rotation fixture 29 is mounted to the frame bottom panel 16*a* to interface with a portion of the multiple contact connector assembly 24, as later described in detail. A reference compass 31 is shown extending through an opening in the dish antenna 18.

Figure 2:
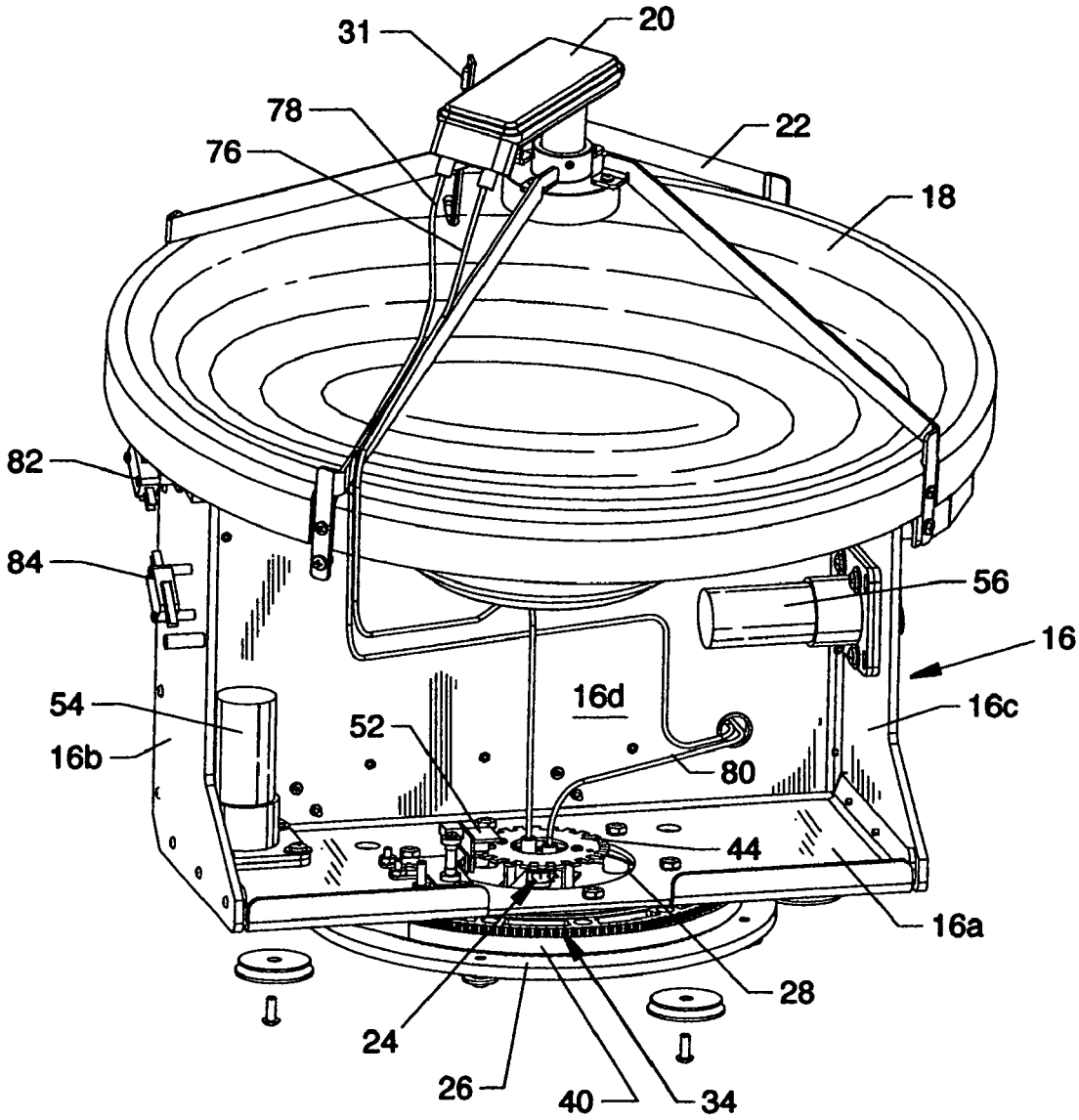
FIG. 2 is an isometric front view of the dish antenna with multiple contact connector assembly with the enclosure base and the enclosure dome removed.
Figure 3:
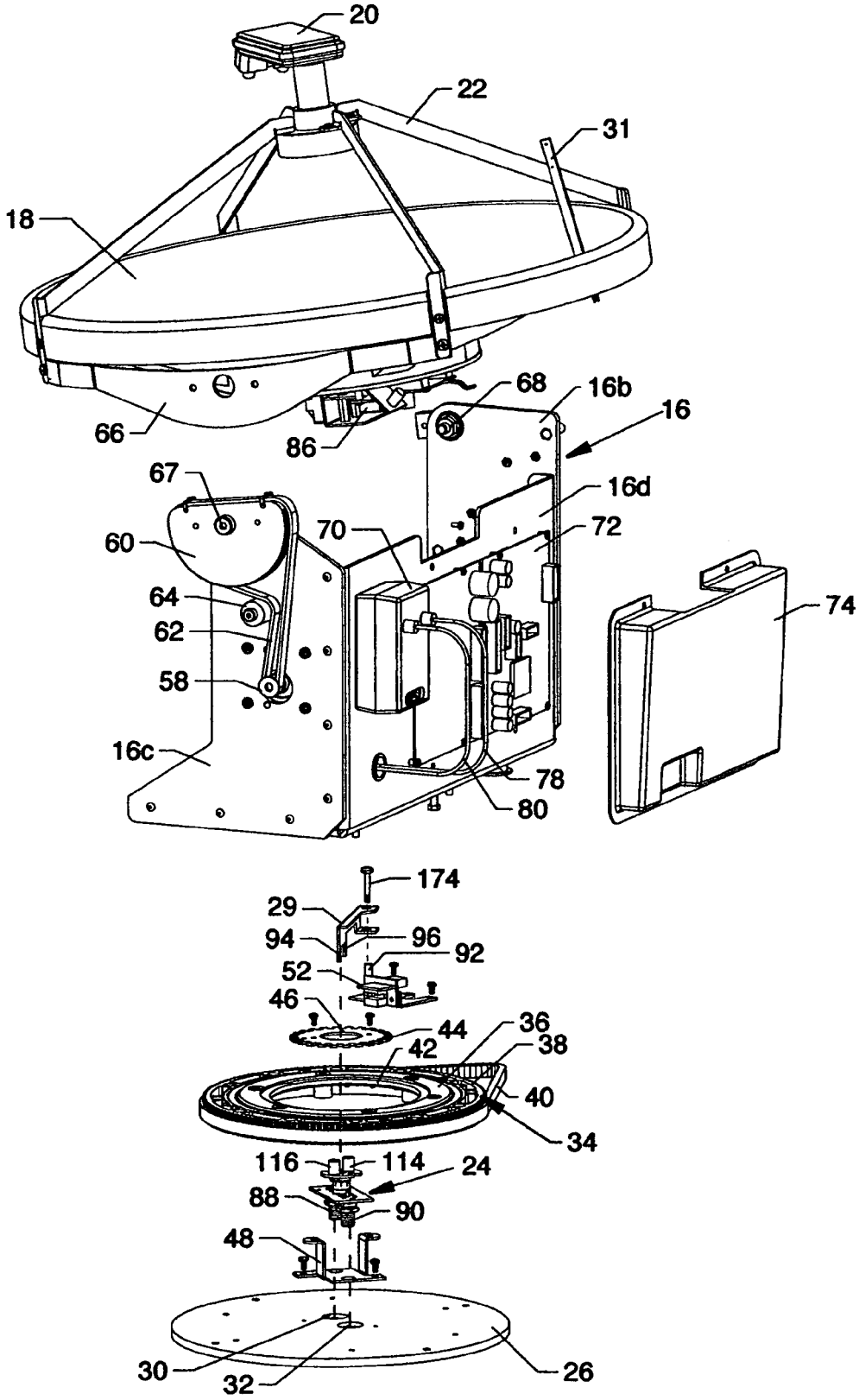
FIG. 3 is an exploded isometric rear view of the dish antenna with multiple contact connector assembly with the enclosure base and the enclosure dome removed.

FIG. 2 is an isometric front view of the dish antenna with multiple contact connector assembly 10 with the enclosure base 12 and the enclosure dome 14 removed, and FIG. 3 is an exploded isometric rear view of the dish antenna with multiple contact connector assembly 10 with the enclosure base 12 and the enclosure dome 14 removed. The rotation fixture 29 also is removed from FIG. 2 and various other figures for the purpose of clarity and unblocked illustration. Description of the invention is now made with reference to FIG. 2 and/or FIG. 3.

Figure 11:
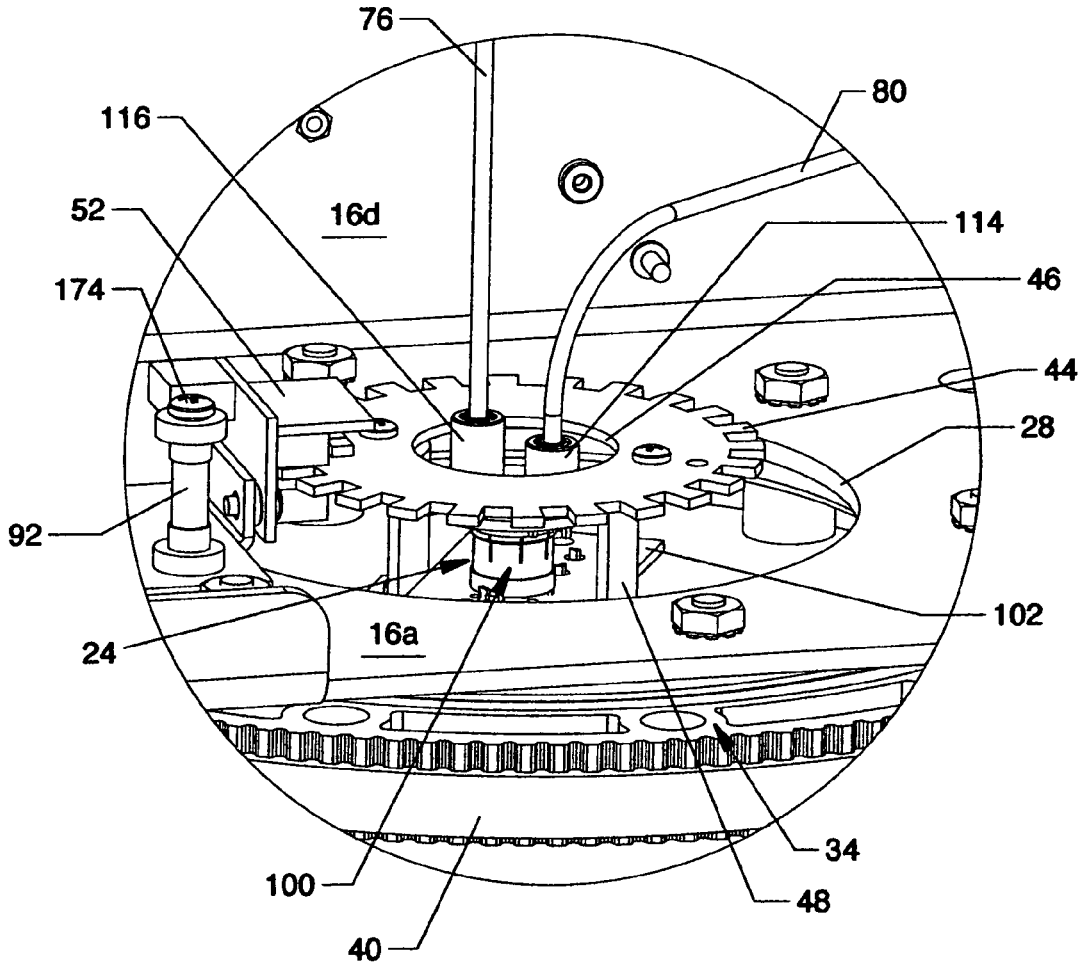
FIG. 11 is an isometric view bounded by a circle showing the relationship of the multiple contact connector assembly to surrounding components with the rotation fixture removed; and, FIG. 12 is a side view of the multiple contact connector assembly mounted to the base plate using a bracket.

Structure is provided for support and azimuthal and elevational control of the dish antenna 18 and the frame 16. Shown in FIG. 2 and/or FIG. 3 are a base plate 26, which preferably is round and has centrally located opposed apertures 30 and 32 and which secures to the enclosure base 12 (FIG. 1), a bearing assembly 34 having an inner part 36 which fixedly secures to the bottom panel 16*a* of the frame 16 and having an outer part 38 which surrounds and which is rotatable about the fixed inner part 36, and a drive belt 40, which alternatively could be a suitable drive chain, suitably aligned to maintain traction about an arcuate portion of the rotatable outer part 38. The base plate 26 is suitably attached to the positionable rotatable outer part 38 of the bearing assembly 34. Also shown is the multiple contact connector assembly 24 which mounts to the base plate 26 via the bracket 48. Cable connector jacks 88 and 90 at the lower portion of the multiple contact connector assembly 24 extend through the bracket 48 and through the apertures 30 and 32 of the base plate 26 and suitably secure therein and thereto. Other components at the lower portion of the multiple contact connector assembly 24 extend through or align within a large aperture 42 of the inner part 36 of the bearing assembly 34, and components at the upper portion of the multiple contact connector assembly 24 extend through or align within the large aperture 28 of the frame bottom panel 16*a* (FIG. 11). A notched optical disk 44 having an aperture 46 attaches at the upper portion of the bracket 48 and the lower portion of the bracket 48 attaches to the base plate 26. The bracket 48 extends through the large aperture 42 of the bearing assembly 34 and through the large aperture 28 of the frame base 16*a* to locate the notched optical disk 44 at a suitable level to interface with an optical sensor assembly 52 to reference azimuthal positioning of the frame 16 and thus the dish antenna 18 with respect to the base plate 26. The notched optical disk 44 includes a small reference magnet (shown in FIG. 5 at 97) useful for initial referencing procedures. The rotation fixture 29 secures to a mounting post 92 on the optical sensor assembly 52 by a screw 174 and includes vertically oriented tabs 94 and 96 that engage a component of the multiple contact connector assembly 24, as later described in detail. A motor, herein called the azimuth motor 54, secures to the frame bottom panel 16*a*, and a portion of the azimuth motor 54 extends through the frame bottom panel 16*a* in order to appropriately interface with the drive belt 40. The azimuth motor 54 provides for azimuthal positioning of the frame 16 and the attached dish antenna 18 with respect to the base plate 26 and other components.

Structure is provided for support and elevational control of the dish antenna 18, as now described. A horizontally oriented motor, herein called the elevation motor 56, secures to the side panel 16*c* and includes a drive pulley 58. A bell crank 60 pivotally attaches to the upper portion of the frame side panel 16*c* by a pivot structure 67 (FIGS. 3 and 4) and is driven about its horizontal pivot axis by a drive belt 62 in cooperation with the drive pulley 58 and an idler pulley 64. The bell crank 60 attaches to and supports one side of a dish support bracket 66. The other side of the dish support bracket 66 is pivotally supported by a pivot structure 68 located on the frame side panel 16*b*.

An RF box 70 (radio frequency) located on the rear of the frame back panel 16*d* functions to sense signal intensity energy from a satellite and controls the azimuth motor 54 and the elevation motor 56 to positionally fine tune the dish antenna 18 for maximum signal intensity and includes a control circuit board 72 which controls motor functions, energy sensing functions, RF signal functions, and other related functions. A control circuit cover 74 covers the control circuit board 72. A coaxial cable 76 connects between the LNB 20 and the multiple contact connector assembly 24, a coaxial cable 78 connects between the LNB 20 and the RF box 70, and a coaxial cable 80 connects between the RF box 70 and the multiple contact connector assembly 24. Also shown are limit switches 82 and 84 located on the frame side panel 16*b* which interact with the dish support bracket 66 to influence elevational limits of the dish antenna 18.

Figure 4:
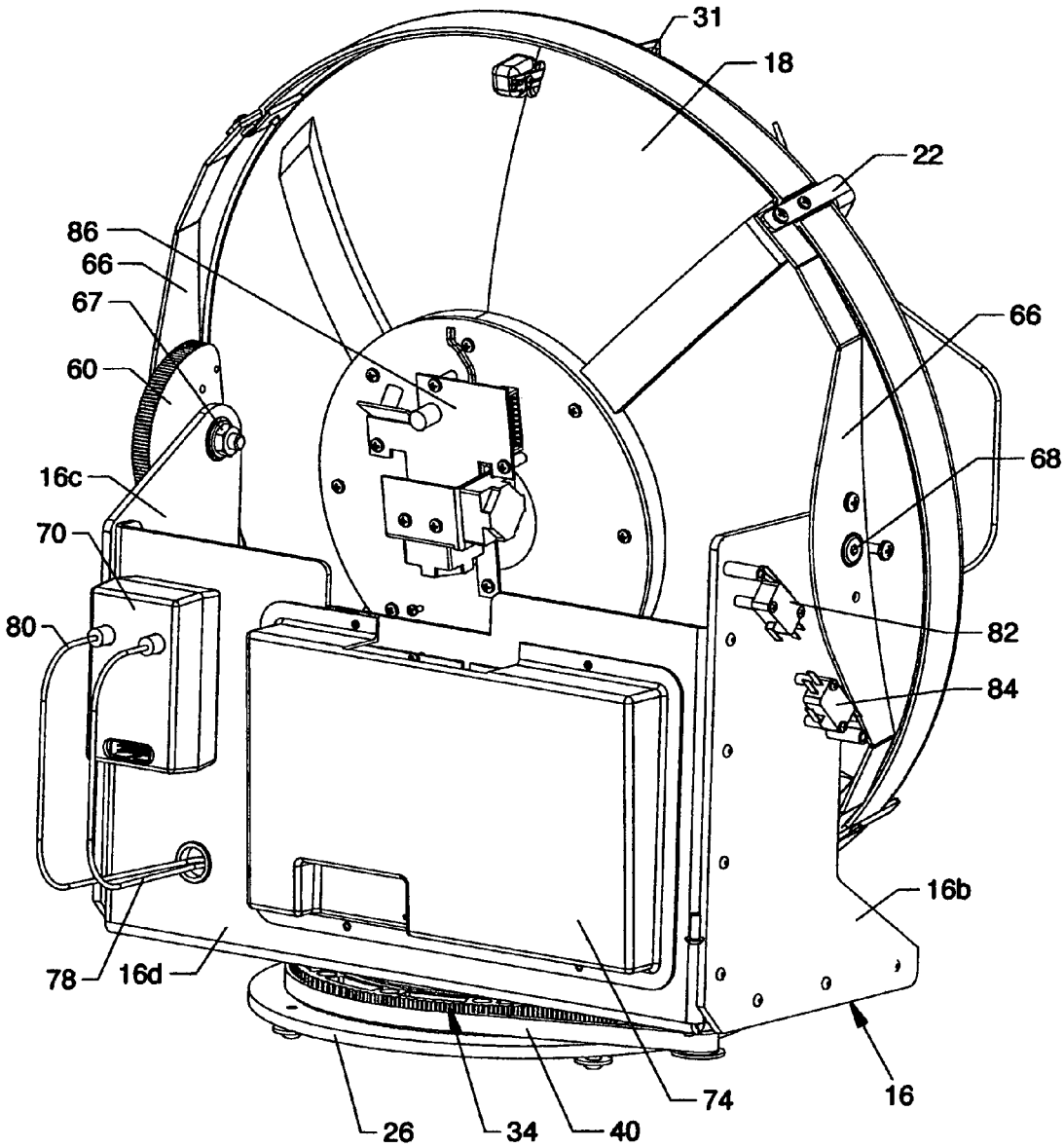
FIG. 4 is a rear isometric view of the dish antenna with multiple contact connector assembly with the enclosure base and the enclosure dome removed.

FIG. 4 is a rear isometric view of the dish antenna with multiple contact connector assembly 10 with the enclosure base 12 and enclosure dome 14 removed. Shown in particular is a gyro assembly 86 mounted to the back of the dish antenna 18. The gyro assembly 86 includes gyros for sensing elevational and azimuthal orientation of the dish antenna 18 for use by the control circuitry or other components.

Figure 5:
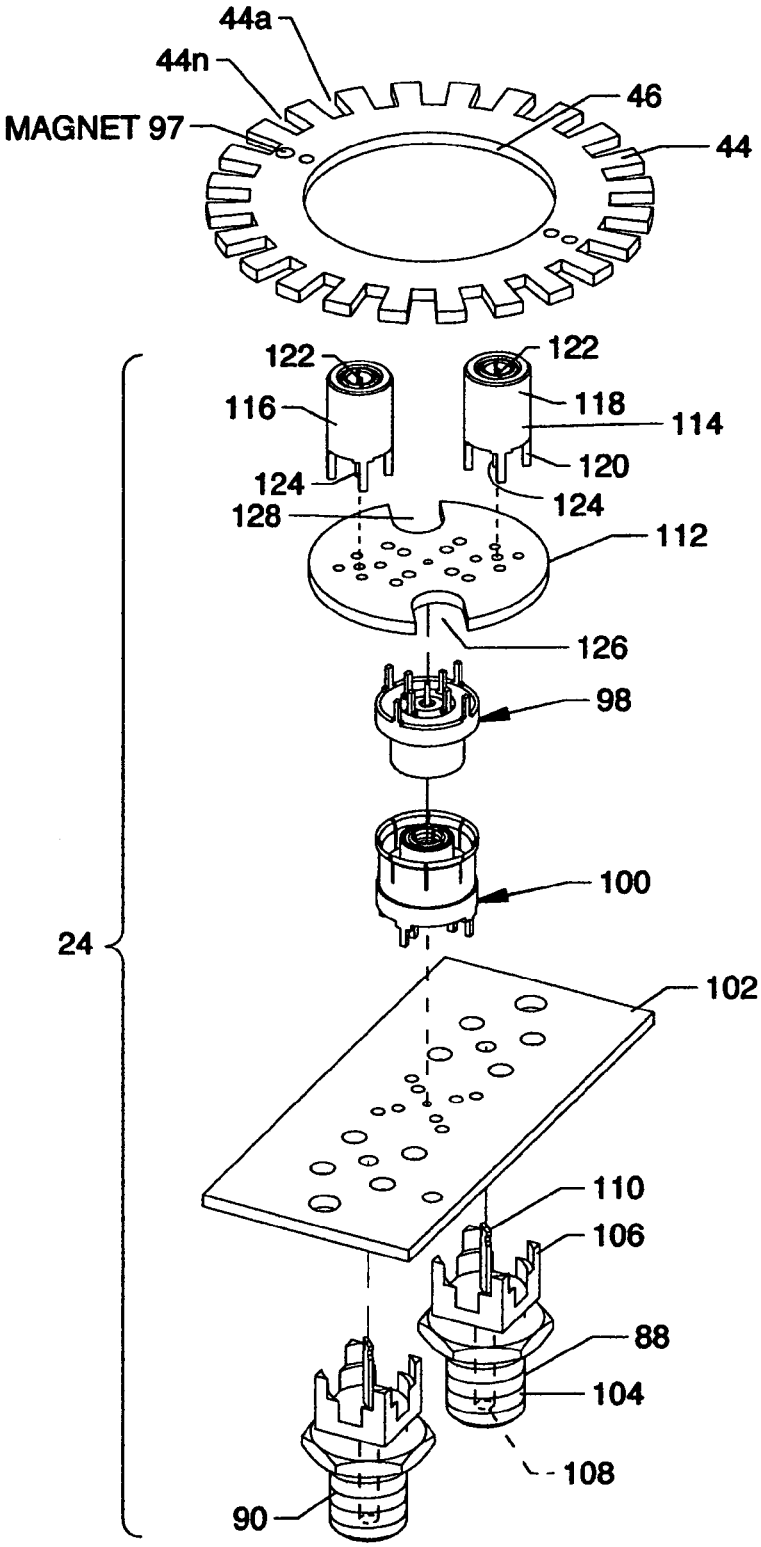
FIG. 5 is an exploded isometric view of the multiple contact connector assembly and an isometric view of the notched optical disk.

FIG. 5 is an exploded isometric view of the multiple contact connector assembly 24 and an isometric view of the notched optical disk 44. Provision is made for inclusion of a magnet 97 to be mounted in the notched optical disk 44 for sensing and referencing by components of the optical sensor assembly 52. The optical sensor assembly 52 also senses and references the notches 44*a*-44*n* of the notched optical disk 44 and/or the material therebetween for azimuth position information pertaining to the frame 16 and mounted dish antenna 18 with respect to the base plate 26 and other components.

The multiple contact connector assembly 24 includes a centrally located multiple contact rotary male connector 98 and a centrally located multiple contact rotary female connector 100 which mutually engage each other in rotary and sliding contact. Both the multiple contact rotary male connector 98 and the multiple contact rotary female connector 100 are depicted as being triaxial connectors, but they are not limited to being triaxial; each can have more contacts than three arranged in concentric fashion. A bottom mounting circuit board 102 includes a plurality of solder pads for accommodation of the multiple contact rotary female connector 100 on the upper surface thereof and for accommodation on the lower surface thereof of the similarly constructed cable connector jacks 88 and 90 each having an outer conductor 104 with connected multiple solder posts 106 and a central conductor 108 with a solder post 110. A top mounting circuit board 112 includes a plurality of solder pads for accommodation of the multiple contact rotary male connector 98 on the lower surface thereof and for accommodation on the upper surface thereof of the similarly constructed cable connector jacks 114 and 116 each having an outer conductor 118 in common with an outer casing having connected multiple solder posts 120 and a central conductor 122 with a solder post 124 (partially visible). Notches 126 and 128 at the periphery of the top mounting circuit board 112 accommodate the vertically aligned tabs 94 and 96 of the rotation fixture 29 to stabilize the top mounting circuit board 112 for prevention of cable wrap-up or winding.

Figure 6:
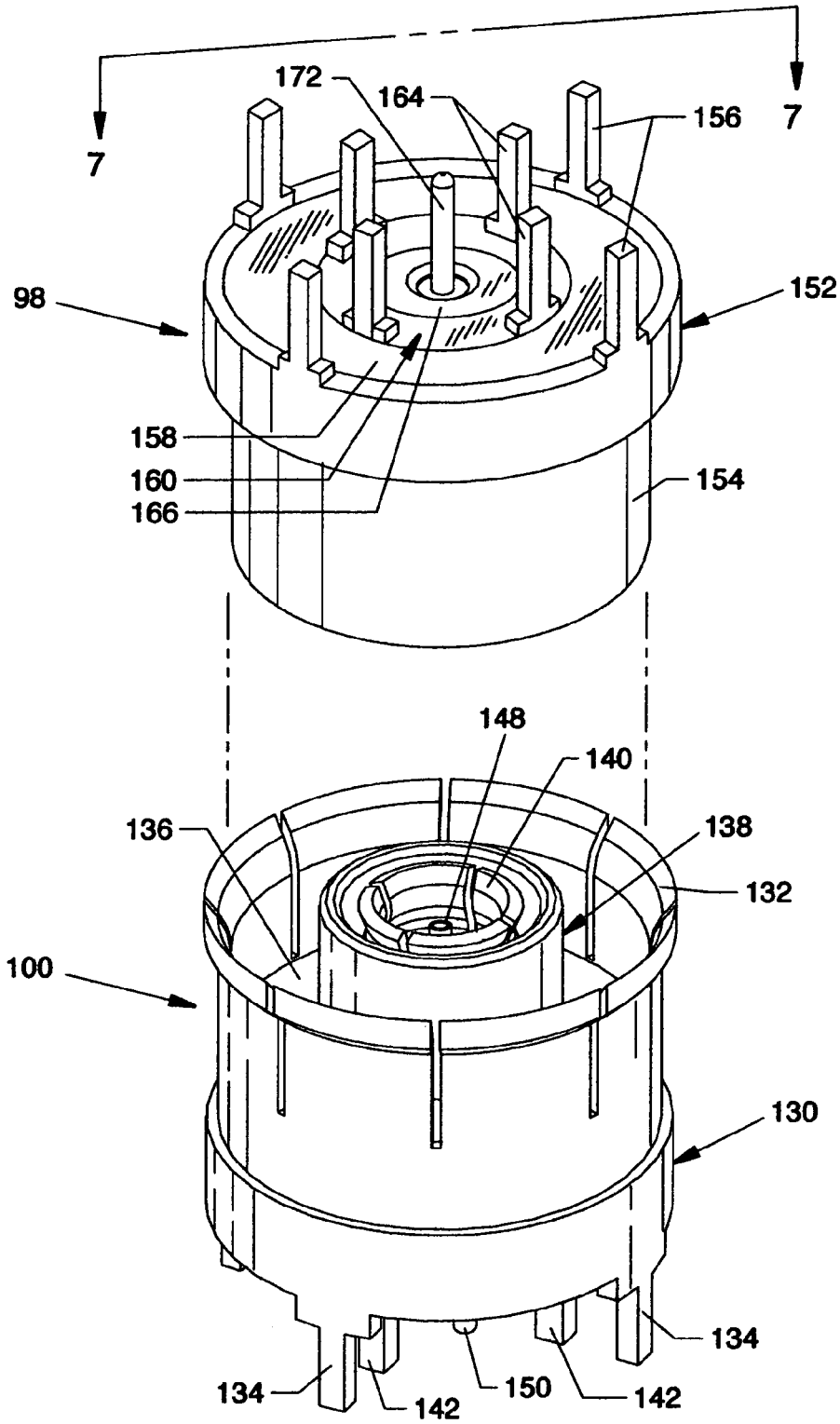
FIG. 6 is an isometric view of the multiple contact rotary male connector and the multiple contact rotary female connector in the separated position.
Figure 7:
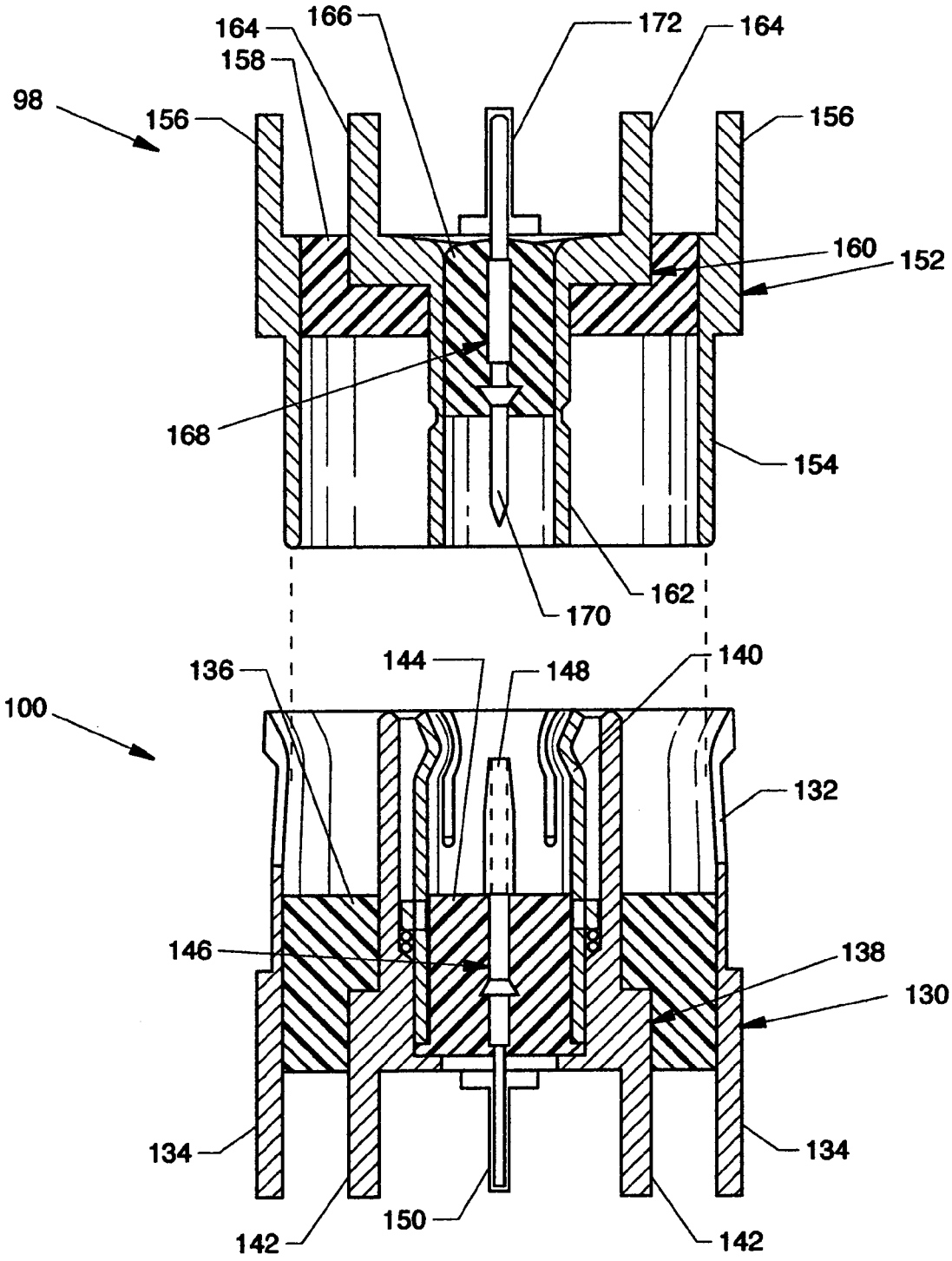
FIG. 7 is a cross section view of the multiple contact rotary male connector and the multiple contact rotary female connector along line 7-7 of FIG. 6.

FIG. 6 is an isometric view of the multiple contact rotary male connector 98 and the multiple contact rotary female connector 100 in separated condition; and FIG. 7 is a cross section view of the multiple contact rotary male connector 98 and the multiple contact rotary female connector 100 along line 7-7 of FIG. 6. With direct reference to FIGS. 6 and 7 and with implied reference to other figures, the multiple contact rotary male connector 98 and the multiple contact rotary female connector 100 are now described. The multiple contact rotary female connector 100 is generally tubular in shape including an outer conductor 130 having a segmented spring contact socket 132 and having a plurality of downwardly extending solder posts 134 which are suitably accommodated by and connected to the central portion of the bottom mounting circuit board 102. An insulator 136 in the form of an annular plastic insert aligns coaxially within a portion of the outer conductor 130. The insulator 136 accommodates an intermediate conductor 138 having a segmented spring contact socket 140 electrically secured thereto and has a plurality of downwardly extending solder posts 142 which are suitably accommodated by and connected to the central portion of the bottom mounting circuit board 102. Another insulator 144 in the form of an annular plastic insert aligns coaxially within a portion of the segmented spring contact socket 140 of the intermediate conductor 138. The insulator 144 accommodates a central conductor 146 having a contact socket 148 and a downwardly extending solder post 150 which is suitably accommodated by and connected to the central portion of the bottom mounting circuit board 102. The multiple contact rotary male connector 98 is generally tubular in shape including an outer conductor 152 having a cylindrical contact 154 and having a plurality of upwardly extending solder posts 156 which are suitably accommodated by and connected to the central portion of the top mounting circuit board 112. An insulator 158 in the form of an annular plastic insert aligns coaxially within a portion of the outer conductor 152. The insulator 158 accommodates an intermediate conductor 160 having a cylindrical contact 162 and a plurality of upwardly extending solder posts 164 which are suitably accommodated by and connected to the central portion of the top mounting circuit board 112. An insulator 166 in the form of an annular plastic insert aligns coaxially within a portion of the intermediate conductor 160. The insulator 166 accommodates a central conductor 168 having a contact pin 170 and an upwardly extending solder post 172 which is suitably accommodated by and connected to the central portion of the top mounting circuit board 112.

Figure 8:
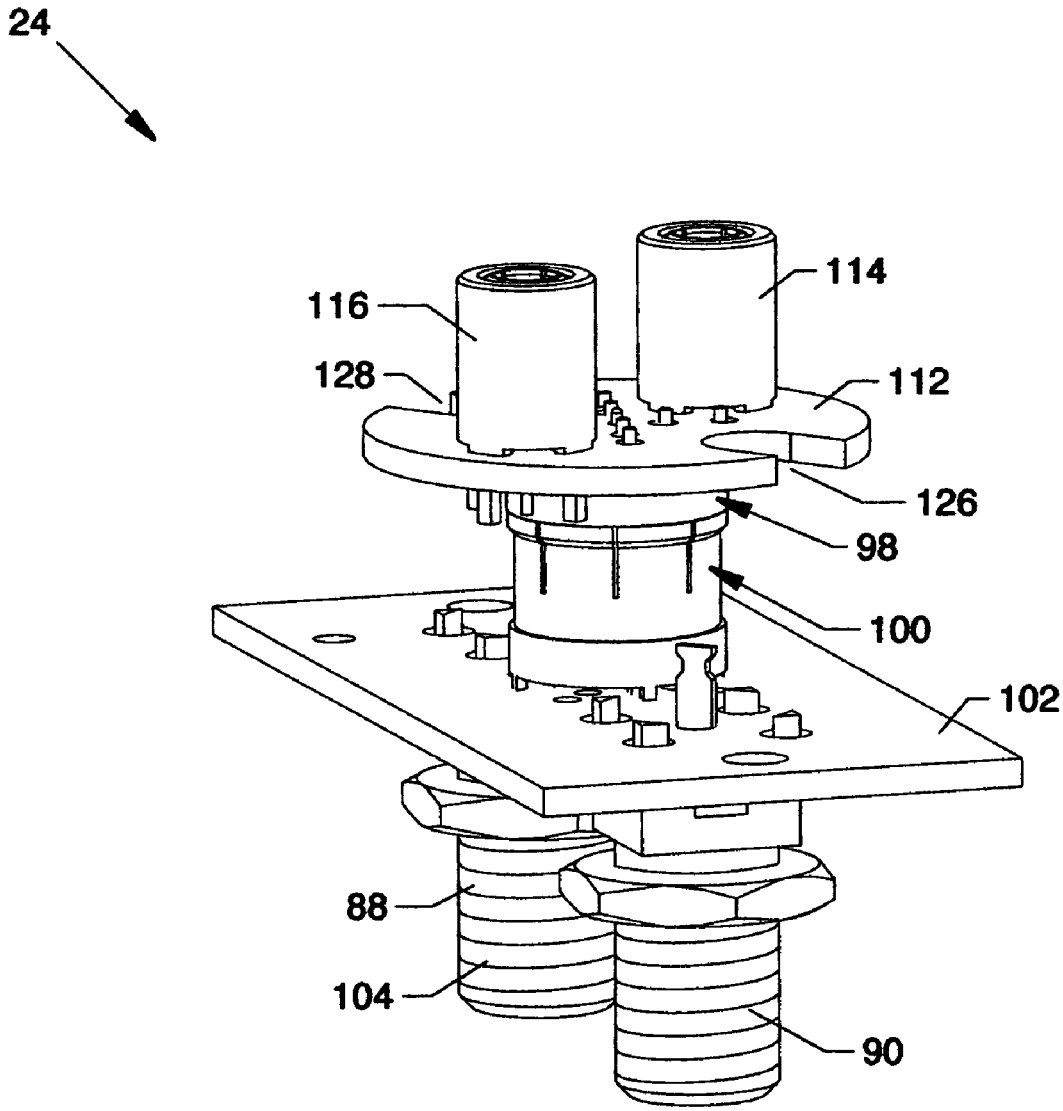
FIG. 8 is an isometric view of the multiple contact connector assembly showing the relationship of the multiple contact rotary male connector and the multiple contact rotary female connector.

FIG. 8 is an isometric view of the multiple contact connector assembly 24 showing the engaged relationship of the multiple contact rotary male connector 98 and the multiple contact rotary female connector 100. The top mounting circuit board 112 including the mounted cable connector jacks 114 and 116 and the mounted multiple contact rotary male connector 98 are continuously and rotatably positionable as a unit with respect to the bottom mounting circuit board 102 including the mounted cable connector jacks 88 and 90 and the mounted multiple contact rotary female connector 100 whereby during static or rotational relationships, uninterrupted electrical connections are maintained regardless of rotational orientation. Although the use of cable connector jacks 88 and 90 is shown in use with the bottom mounting circuit board 102, it is to be appreciated that, alternatively, a bottom mounting circuit board using solder pads in lieu of the cable connector jacks 88 and 90 can be used for direct soldered connection of coaxial cables thereto, thereby providing connections which have less signal loss and are less susceptible to connector corrosion and the like. Similarly, a top mounting circuit board using solder pads in lieu of the cable connector jacks 114 and 116 can be used for direct soldered connection of coaxial cables thereto, thereby providing connections which have less signal loss and are less susceptible to connector corrosion and the like.

Figure 9:
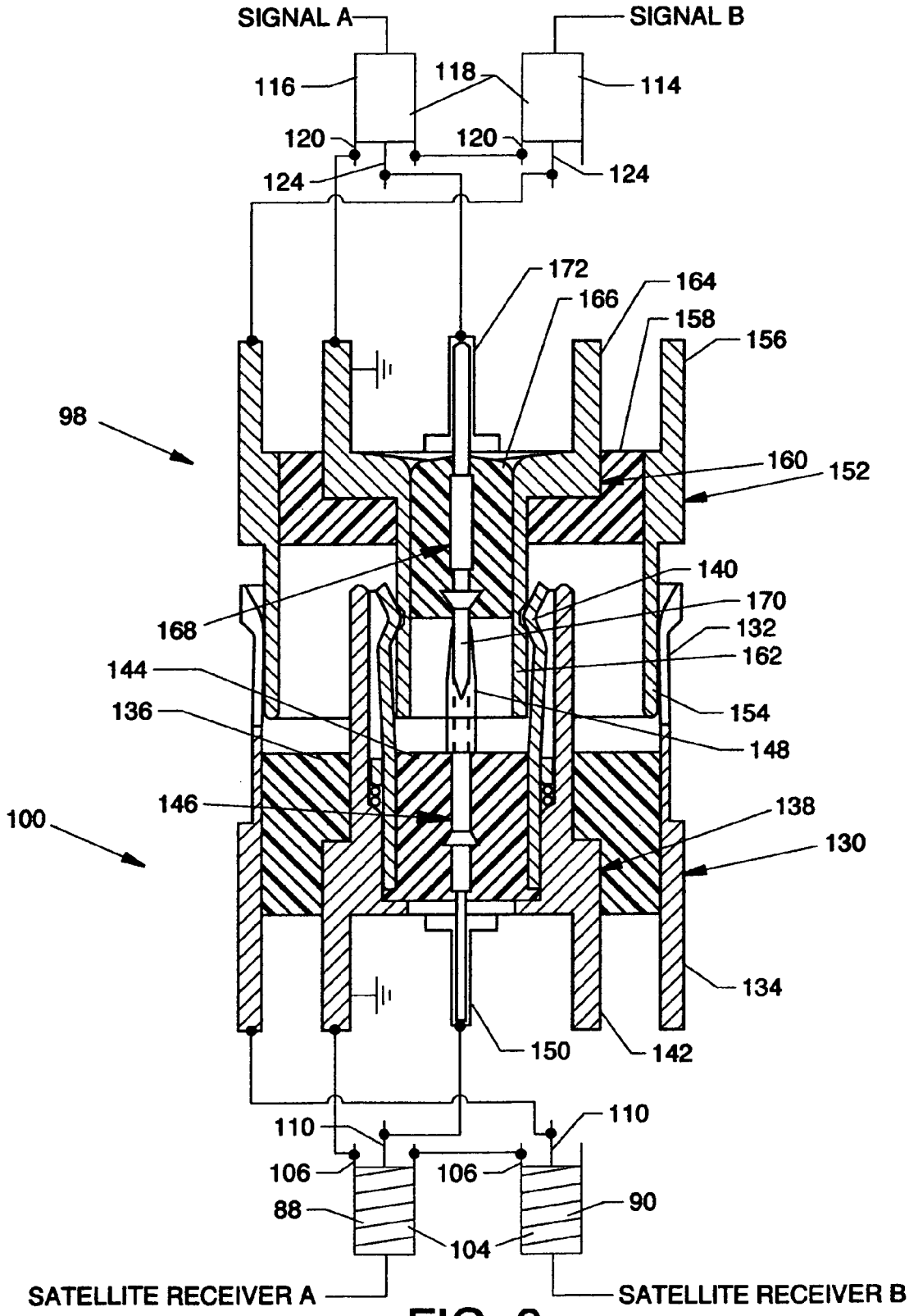
FIG. 9 utilizes the cross section views shown in FIG. 7 showing the engaged relationship of the multiple contact rotary male connector and the multiple contact rotary female connector and the continuously maintained circuit paths incorporated therethrough and within the other portions of the multiple contact connector assembly during static or rotational states.

FIG. 9 includes the cross section view shown in FIG. 7 showing the engaged relationship of the multiple contact rotary male connector 98 and the multiple contact rotary female connector 100 and the continuously maintained circuit paths incorporated therethrough and within the other portions of the multiple contact connector assembly 24 during static or rotational states. For purposes of example and illustration, such as for TV reception or two-way data exchange continuous transfer of a "signal A" to a "satellite receiver A" and continuous transfer of a "signal B" to a "satellite receiver B" is demonstrated. A common electrical path is continuously maintained by the segmented spring contact socket 140 and solder posts 142 of the intermediate conductor 138 of the multiple contact rotary female connector 100 through the cylindrical contact 162 and solder posts 164 of the intermediate conductor 160 of the multiple contact rotary male connector 98 to connect the common outer conductors 104 of the cable connector jacks 88 and 90 incorporating solder posts 106 to the common outer conductors 118 of the cable connector jacks 114 and 116 incorporating solder posts 120. A dedicated electrical path is continuously maintained by the contact socket 148 and solder post 150 of the central conductor 146 of the multiple contact rotary female connector 100 through the contact pin 170 and solder post 172 of the central conductor 168 of the multiple contact rotary male connector 98 to connect the central conductor 108 (FIG. 5) of the cable connector jack 88 incorporating solder post 110 to the central conductor 122 (FIG. 5) of the cable connector jack 116 incorporating solder post 124. Another dedicated electrical path is continuously maintained by the segmented spring contact socket 132 and solder posts 134 of the outer conductor 130 of the multiple contact rotary female connector 100 through the cylindrical contact 154 and solder posts 156 of the outer conductor 152 of the multiple contact rotary male connector 98 to connect the central conductor 108 (FIG. 5) of the cable connector jack 90 incorporating solder post 110 to the central conductor 122 of the cable connector jack 114 incorporating solder post 124. The intermediate conductor 138 of the multiple contact rotary female connector 100 and the engaged intermediate conductor 160 of the multiple contact rotary male connector 98 together conveniently act as a shield between the combined central conductor 146 of the multiple contact rotary female connector 100 and the engaged central conductor 168 of the multiple contact rotary male connector 98 and the combined outer conductor 130 of the multiple contact rotary female connector 100 and the engaged outer conductor 152 of the multiple contact rotary male connector 98.

Figure 10:
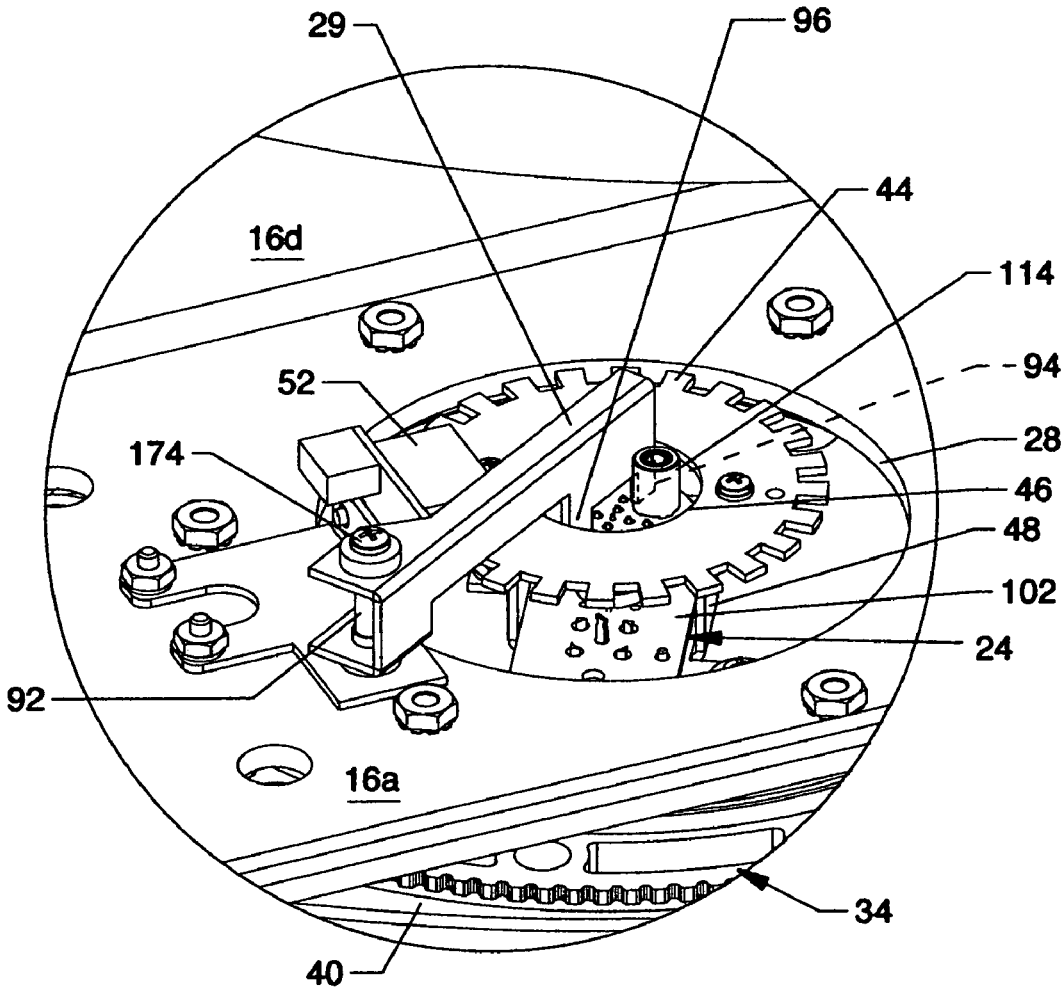
FIG. 10 is an isometric view bounded by a circle showing the relationship of the multiple contact connector assembly to surrounding components including a rotation fixture.

FIG. 10 is an isometric view bounded by a circle showing the relationship of the multiple contact connector assembly 24 to surrounding components. Shown in particular is the rotation fixture 29 secured to the mounting post 92 of the optical sensor assembly 52 by the screw 174, wherein the tabs 94 and 96, also shown in FIG. 3, engage the opposed notches 126 and 128 of the top mounting circuit board 112 (FIG. 5) in a suitable and convenient order. Thus, the top mounting circuit board 112 is held in position and referenced to the position of the coaxial cables 76 and 80 to preclude unwanted cable twisting or wrap-up and to positionally fix and anchor the top mounting circuit board 112 and attached components to prevent turning in unison of the top mounting circuit board 112 with the bottom mounting circuit board 102 which is attached to the base plate 26. Such referencing is beneficial whether the frame 16 is rotated relative to the base plate 26 or whether the base plate 26 is rotated relative to the frame 16 during signal reception and vehicle movement.

FIG. 11 is an isometric view bounded by a circle showing the relationship of the multiple contact connector assembly 24 to surrounding components. The rotation fixture 29 shown in FIG. 10 is removed for the purpose of clarity and unblocked illustration. Shown in particular is the support of the notched optical disk 44 above the level of the large aperture 28 by the bracket 48 and the relationship of the bracket 48 to the multiple contact connector assembly 24.

Figure 12:
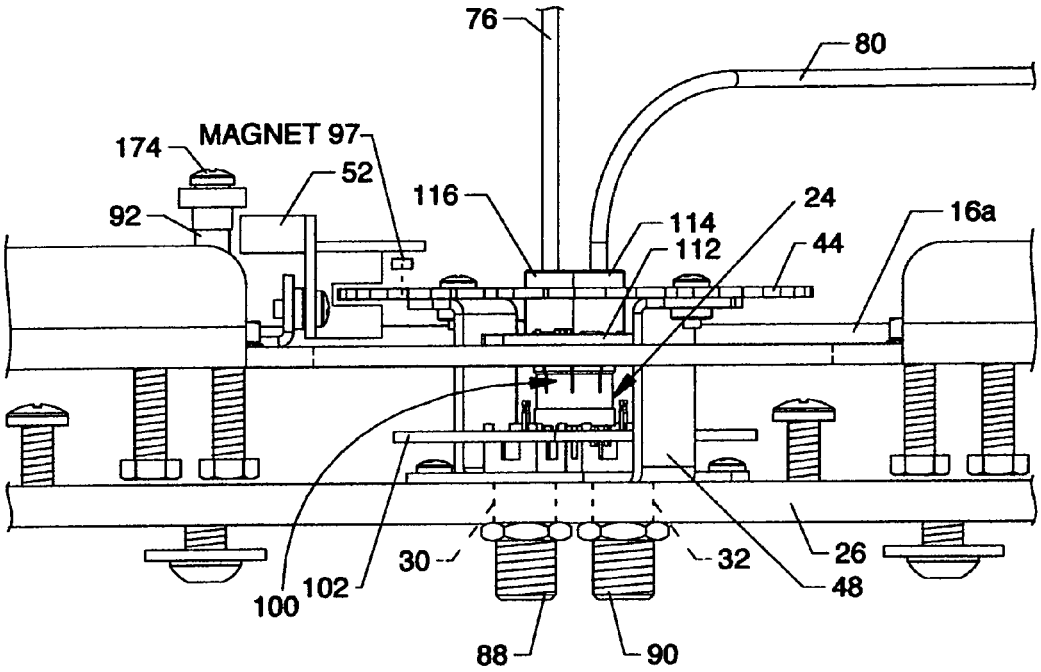

FIG. 12 is a side view of the multiple contact connector assembly 24 mounted to the base plate 26 using the bracket 48. The bearing assembly 34 and the rotation fixture 29 have been removed for the purpose of clarity and unblocked illustration.

MODE OF OPERATION

FIG. 9 best illustrates the mode of operation of the dish antenna with multiple contact connector assembly 10 with special attention directed to the multiple contact connector assembly 24. Operation of other associated electrical and mechanical components of the instant invention are known in the art.

Various modifications can be made to the present invention without departing from the apparent scope hereof.

DISH ANTENNA WITH MULTIPLE CONTACT CONNECTOR ASSEMBLY PARTS LIST

10 dish antenna with multiple contact connector assembly
12 enclosure base
14 enclosure dome
16 frame
**16*a*** bottom panel
**16*b*** side panel
**16*c*** side panel
**16*d*** back panel
18 dish antenna
20 LNB (low noise block)
22 LNB mounting framework
24 multiple contact connector assembly
26 base plate
28 large aperture
29 rotation fixture
30 aperture
31 reference compass
32 aperture
34 bearing assembly
36 inner part
38 outer part
40 drive belt
42 large aperture
44 notched optical disk
**44*a-n*** notches
46 aperture
48 bracket
52 optical sensor assembly

54 azimuth motor
56 elevation motor
58 drive pulley
60 bell crank
62 drive belt
64 idler pulley
66 dish support bracket
67 pivot structure
68 pivot structure
70 RF box
72 control circuit board
74 control circuit cover
76 coaxial cable
78 coaxial cable
80 coaxial cable
82 limit switch
84 limit switch
86 gyro assembly
88 cable connector jack
90 cable connector jack
92 mounting post
94 tab
96 tab
97 magnet
98 multiple contact rotary male connector
100 multiple contact rotary female connector
102 bottom mounting circuit board
104 outer conductor
106 solder post
108 central conductor
110 solder post
112 top mounting circuit board
114 cable connector jack
116 cable connector jack
118 outer conductor
120 solder post
122 central conductor
124 solder post
126 notch
128 notch
130 outer conductor
132 segmented spring contact socket
134 solder post
136 insulator
138 intermediate conductor
140 segmented spring contact socket
142 solder post
144 insulator
146 central conductor
148 contact socket
150 solder post
152 outer conductor
154 cylindrical contact
156 solder post
158 insulator
160 intermediate conductor
162 cylindrical contact
164 solder post
166 insulator
168 central conductor
170 contact pin
172 solder post
174 screw It is claimed:

1. A multiple contact rotary male connector and a multiple contact rotary female connector including provisions for a sliding common contact means for cooperation with and for conveying signals or other voltages through two other sliding contact means comprising:

a. said multiple contact rotary female connector including a contact socket which rotatingly and slidingly engages a contact pin in the multiple contact rotary male connector for communication of a first RF signal or other electrical current therethrough;

b. said multiple contact rotary female connector including an intermediate conductor in communication with and in coaxial alignment with a first segmented spring contact socket which together serve as a conductor for communication of common RF signals or other electrical current; the first segmented spring contact socket being flexible and rotatingly and slidingly engaging a first cylindrical contact of the multiple contact rotary male connector for communication of a common RF signal or other common electrical current therethrough; and, c. said multiple contact rotary female connector including an outer conductor for communication of an RF signal or other electrical current having a second segmented spring contact socket which is flexible and which rotatingly and slidingly engages a second cylindrical contact of the multiple contact rotary male connector for communication of a second RF signal.

* * * * *